US006904718B2

(12) United States Patent
Fox

(10) Patent No.: US 6,904,718 B2
(45) Date of Patent: Jun. 14, 2005

(54) LEAF GUARD FOR GUTTERS

(76) Inventor: Stephen P. Fox, 3300 Lester Ave., Hasting, MN (US) 55033

( * ) Notice: Subject to any disclaimer, the term of this patent is extended or adjusted under 35 U.S.C. 154(b) by 0 days.

(21) Appl. No.: 10/820,070

(22) Filed: Apr. 8, 2004

(65) Prior Publication Data

US 2005/0097826 A1 May 12, 2005

Related U.S. Application Data

(63) Continuation-in-part of application No. 10/702,521, filed on Nov. 7, 2003.

(51) Int. Cl.[7] ..... W04D 13/00
(52) U.S. Cl. ..... 52/12; 52/11
(58) Field of Search ..... 52/11, 12

(56) References Cited

U.S. PATENT DOCUMENTS

| | | | | | |
|---|---|---|---|---|---|
| 4,435,925 | A | * | 3/1984 | Jefferys | 52/12 |
| 4,631,875 | A | * | 12/1986 | Olson | 52/12 |
| 5,010,696 | A | * | 4/1991 | Knittel | 52/12 |
| 5,127,200 | A | * | 7/1992 | Doran | 52/12 |
| 5,216,852 | A | * | 6/1993 | Bemis et al. | 52/12 |
| 5,409,602 | A | * | 4/1995 | Sorenson | 210/162 |
| 5,457,916 | A | | 10/1995 | Tenute | |
| 5,459,965 | A | | 10/1995 | Meckstroth | |
| 5,471,798 | A | * | 12/1995 | Kuhns | 52/12 |
| 5,495,694 | A | | 3/1996 | Kuhns | |
| 5,640,809 | A | | 6/1997 | Iannelli | |
| 5,864,990 | A | * | 2/1999 | Tu | 52/19 |
| 6,016,631 | A | | 1/2000 | Lowrie, III | |
| 6,098,344 | A | | 8/2000 | Albracht | |
| 6,161,338 | A | | 12/2000 | Kuhns | |
| 6,269,592 | B1 | | 8/2001 | Rutter | |
| 6,412,228 | B1 | | 7/2002 | Meckstroth | |
| 2002/0069594 | A1 | | 6/2002 | Sweet | |
| 2002/0152692 | A1 | | 10/2002 | Bahroos et al. | |
| 2002/0166290 | A1 | | 11/2002 | Bergeron | |
| 2003/0009951 | A1 | | 1/2003 | Bergeron | |
| 2003/0029129 | A1 | | 2/2003 | Walters | |

FOREIGN PATENT DOCUMENTS

| | | |
|---|---|---|
| GB | 2138046 A | 10/1984 |
| JP | 6146506 | 5/1994 |

* cited by examiner

*Primary Examiner*—Peter M. Cuomo
*Assistant Examiner*—Erika Garrett
(74) *Attorney, Agent, or Firm*—Richard C. Litman

(57) ABSTRACT

The leaf guard for gutters is an elongated sheet of enamel coated aluminum adapted to fit over the rain gutter on a house in a manner that directs water flow from the roof into the gutter while preventing leaves and other debris from entering the gutter. In a first embodiment, the guard is formed into a planar section that is secured to a roof, a curved nose section extending from the planar section, a trough under the curved section and a cornered lip extending from the trough to secure the device to the outer rim of a gutter. In a second embodiment, the guard is formed into a planar section, an inwardly bent connection section that is connected to the inner rim of a gutter, and a curved nose section that hangs over the outer rim of the gutter. The guard also has rows of elongated slits in the planar section that permit some water to drip through to prevent bees and other insects from nesting beneath the device. The device is bendable such that the slope of the planar section can be changed to meet the varying needs.

20 Claims, 6 Drawing Sheets

LEAF GUARD FOR GUTTERS

CROSS-REFERENCE TO RELATED APPLICATION

This application is a continuation-in-part of U.S. patent application Ser. No. 10/702,521, filed Nov. 7, 2003.

BACKGROUND OF THE INVENTION

1. Field of the Invention

The present invention relates to rain gutters used on houses and other structures, and more particularly, to a gutter cover that directs water flow from a roof into a rain gutter while preventing leaves and other debris from entering the gutter, and preventing the nesting of bees and other insects under the gutter cover.

2. Description of the Related Art

Gutter covers are used to prevent debris such as leaves and twigs from entering and accumulating in gutters. The covers typically extend from the roofline of a house to the outside rim of the gutters and include either holes or a trough to allow water to flow into the gutters while preventing debris from doing the same. By preventing the accumulation of debris in gutters, gutter covers allow homeowners and maintenance workers to avoid the problems associated with clogged gutters without having to periodically use a ladder to clean the gutters.

Although useful for preventing the accumulation of debris in gutters, prior art gutter covers suffer from several known drawbacks. Perhaps the most common drawback associated with gutter covers is the nesting of bees and other insects. Gutter covers that consist simply of a solid sheet of material extending from a roofline to the gutter rim with a single trough disposed along the inner aspect of the gutter rim provide an ideal environment for bees and other insects to nest. Bees and other insects build their nests on the underside of the cover where they remain dry in all but the most severe rainstorms. Examples of gutter covers particularly susceptible to nesting of bees and other insects in this manner are provided by U.S. Pat. App. No. 2002/0152692 published Oct. 24, 2002 on behalf of G. Bahroos et al.; U.S. Pat. No. 5,457,916 issued Oct. 17, 1995 to S. J. Tenute; U.S. Pat. No. 5,459,965 issued Oct. 24, 1995 to A. F. Meckstroth; U.S. Pat. No. 5,640,809 issued Jun. 24, 1997 to A. M. Iannelli; and U.S. Pat. No. 6,098,344 issued Aug. 8, 2000 to G. P. Albracht.

Another problem associated with gutter covers relates to the manner in which they are installed. The use of customized clips, brackets or hangers is required to install and maintain many prior art gutter covers. However, these customized clips, brackets and hangers not only add to the expense of the covers but they also often complicate and lengthen the installation of the covers. Examples of gutter covers installed with customized parts are provided by U.S. Pat. App. No. 2002/0069594 published Jun. 13, 2002 on behalf of V. L. Sweet; U.S. Pat. App. No. 2003/0029129 published Feb. 13, 2003 on behalf of A. B. Walters; U.S. Pat. Nos. 5,495,694 and 6,161,338 issued, respectfully, Mar. 5, 1996 and Dec. 19, 2000 to R. L. Kuhns; U.S. Pat. No. 6,016,631 issued Jan. 25, 2000 to E. G. Lowrie, III; U.S. Pat. No. 6,269,592 issued Aug. 7, 2001 to K. M. Rutter; and U.S. Pat. No. 6,412,228 issued Jul. 2, 2002 to A. F. Meckstroth.

Gutter covers lacking a trough typically consist of a substantially planar piece of material extending from the roofline to the gutter rim with rows of holes aligned parallel to the gutter rim, as exemplified by the devices taught by U.S. Pat. App. Nos. 2002/0166290 and 2003/0009951 published, respectfully, Nov. 14, 2002 and Jan. 16, 2003 on behalf of R. S. Bergeron; U.S. Pat. No. 4,631,875 issued Dec. 30, 1986 to C. D. Olson; and United Kingdom Pat. App. No. GB 2138046A published Oct. 17, 1984 on behalf of C. R. Wooward. During heavy rains water flows off the roof and across the cover at a speed where little of the water is able to drop through the holes into the gutter. Instead much of the water simply flows over the outer gutter rim rendering the gutter useless.

Accordingly, there is a need for a single gutter cover that prevents bee nesting, is easily installed without customized parts, and minimizes or eliminates ineffectiveness during heavy rains.

SUMMARY OF THE INVENTION

In the first embodiment, the leaf guard for gutters is an elongated sheet of enamel coated aluminum adapted to fit over the rain gutter on a house in a manner that directs water flow from the roof into the gutter while preventing leaves and other debris from entering the gutter. The device is formed into a planar section that is secured to a roof, a curved nose section extending from the planar section, a trough under the curved nose section and a cornered lip extending from the trough to secure the device to the outer rim of a gutter. The device also has one or more rows of elongated slits in the planar section that permit some water to drip through to prevent bees and other insects from nesting on its underside. The device is bendable such that the slope of the planar section can be changed to meet the varying needs of different roof styles.

In the second embodiment, the leaf guard for gutters is an elongated sheet of enamel coated aluminum adapted to be connected to the facia board of a house in a manner that directs water flow from the roof into the gutter while preventing leaves and other debris from entering the gutter. The device is formed into a planar section, a inwardly bent connection section that is adapted to connect to the facia board, and a curved nose section extending from the planar section that is positioned close to the outer rim of the gutter such that a gap is provided to allow water to flow into the gutter while preventing leaves and other debris from entering the gutter. The device also has one or more rows of elongated slits in the planar section that permit some water to drip through to prevent bees and other insects from nesting on its underside.

It is the principal object of the invention to provide a gutter cover that directs water flow from a roof into a gutter while preventing leaves and other debris from entering the gutter.

It is another object of the invention to provide a gutter cover that permits some water to drip through to its underside to prevent bees and other insects from nesting under the cover.

It is a further object of the invention to provide a gutter cover that is bendable such that the slope of its planar section can be changed to meet the varying needs of different roof styles.

Still another object of the invention is to provide a gutter cover that acts to reduce the velocity of the water running down the leaf guard in order to ensure that the water flows into the gutter.

Still another object of the invention is to provide a gutter cover that does not require or include the use of customized parts including customized clips, brackets or hangers.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
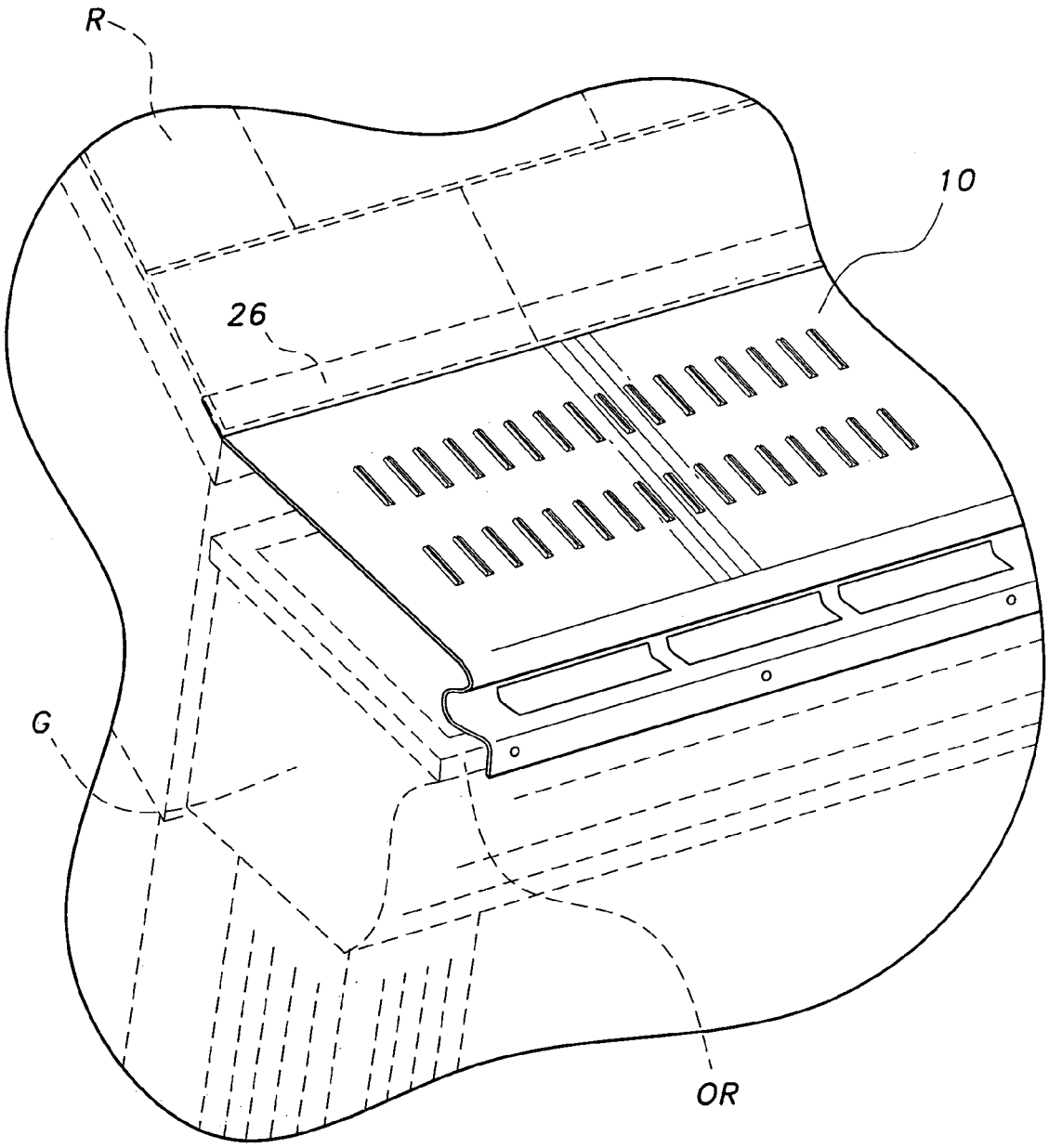
FIG. 1 is a fragmented, environmental, perspective view of the first embodiment of the leaf guard for gutters according to the present invention shown mounted on the gutter of a house.
Figure 2:
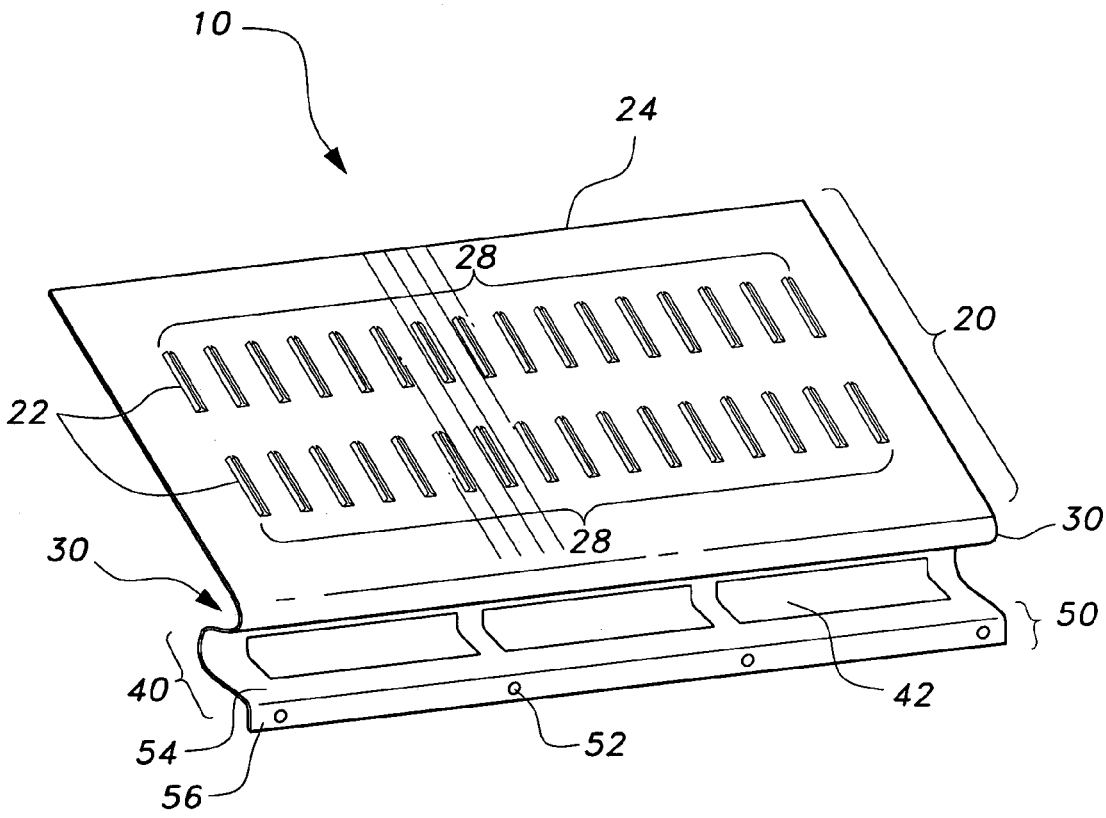
FIG. 2 is an elevational, perspective view of the first embodiment of the leaf guard for gutters according to the present invention.
Figure 3:
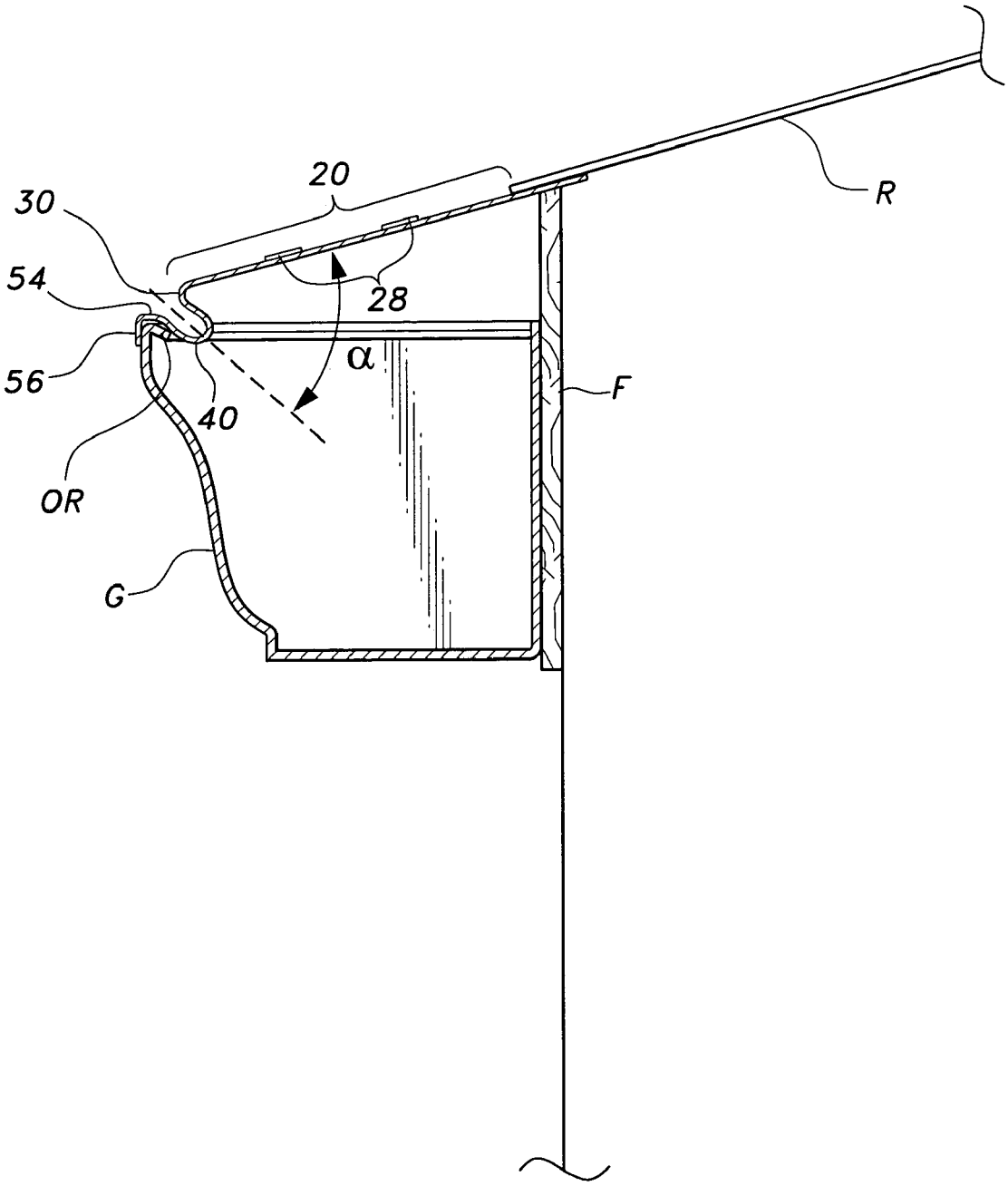
FIG. 3 is a cross sectional view of the first embodiment of the leaf guard for gutters according to the present invention shown mounted on the gutter of a house.
Figure 4:
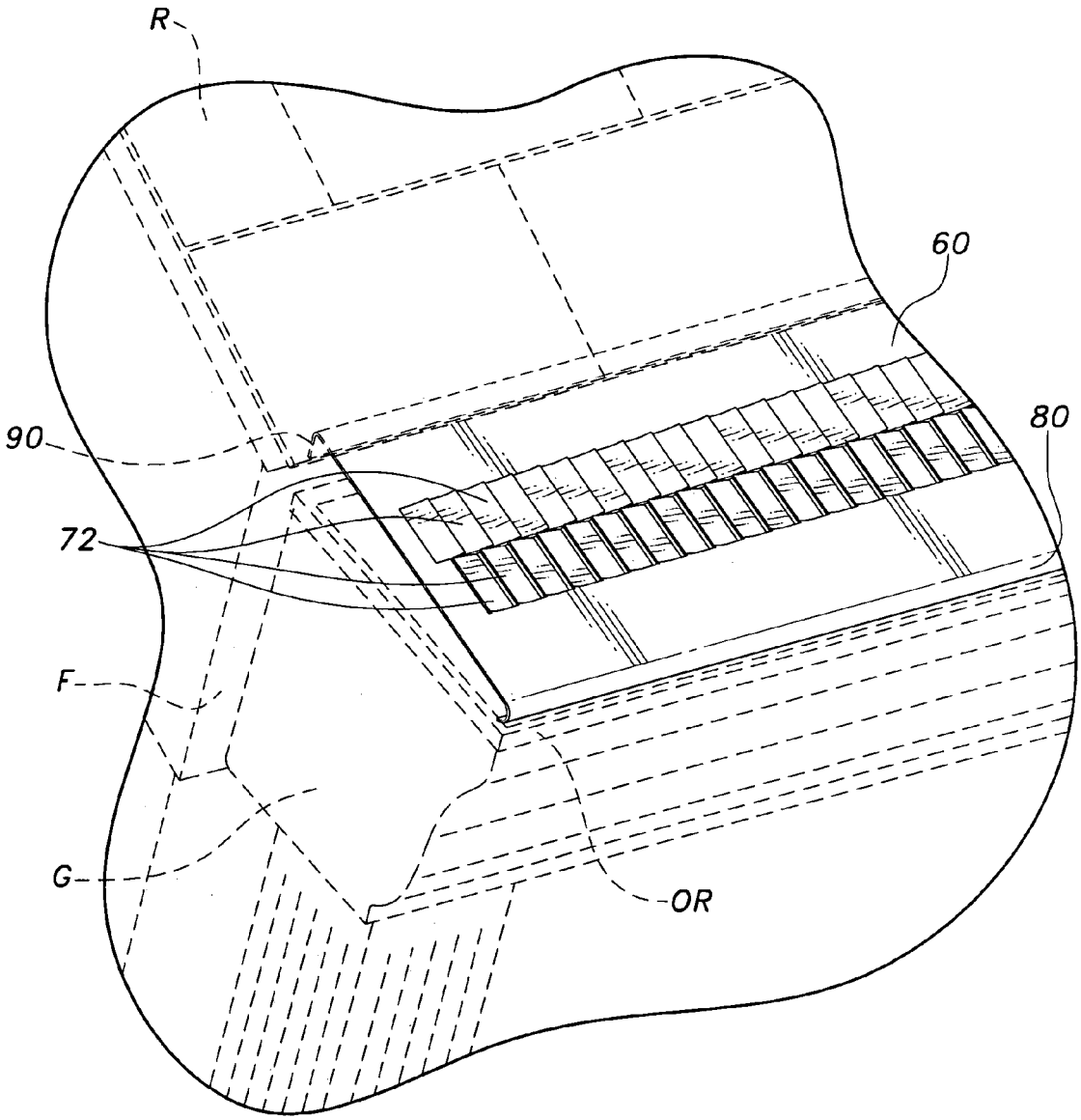
FIG. 4 is a fragmented, environmental, perspective view of the second embodiment of the leaf guard for gutters according to the present invention shown mounted above a gutter on a house.
Figure 5:
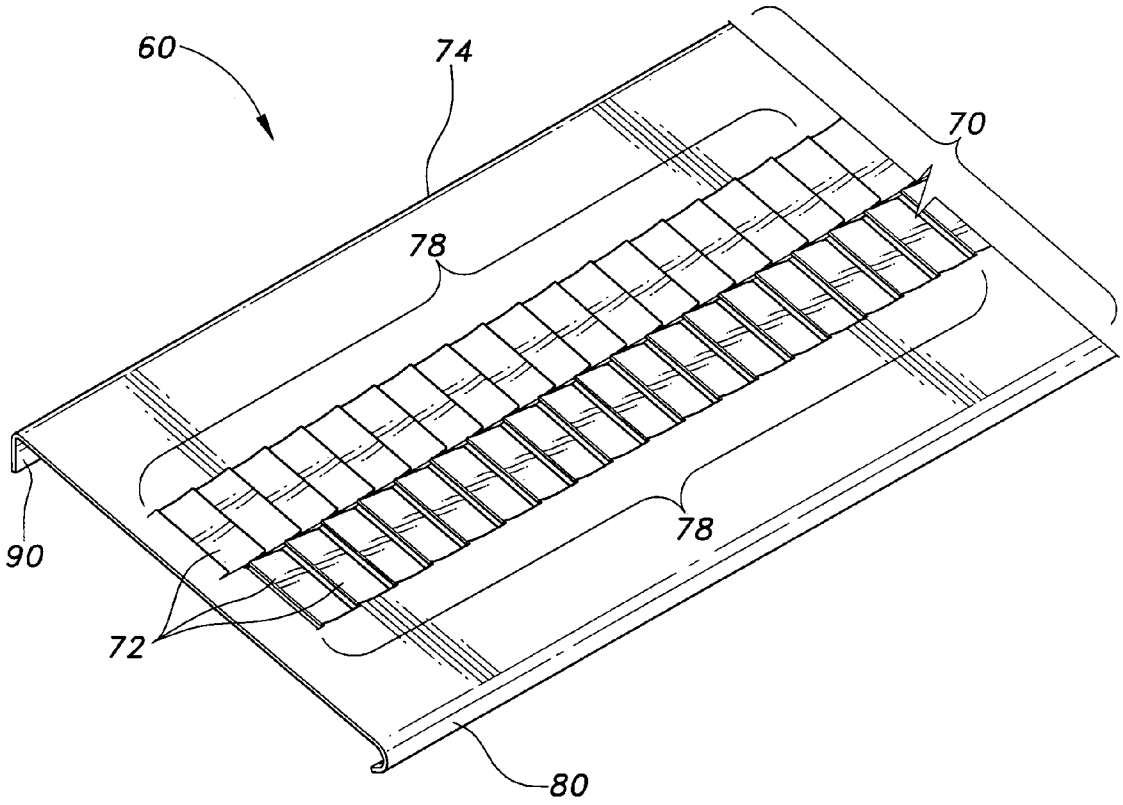
FIG. 5 is an elevational, perspective view of the second embodiment of the leaf guard for gutters according to the present invention.
Figure 6:
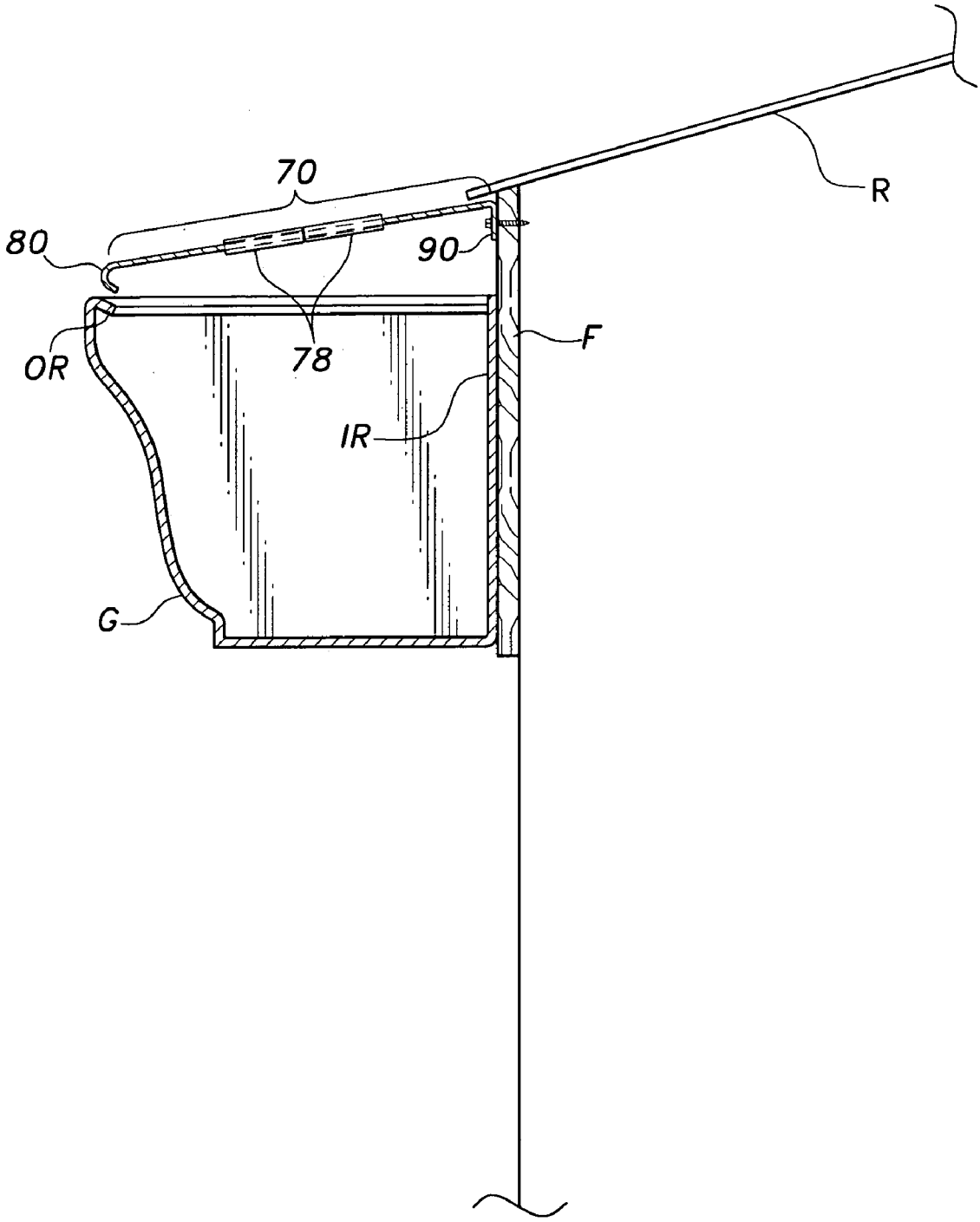
FIG. 6 is a cross sectional view of the second embodiment of the leaf guard for gutters according to the present invention shown mounted above a gutter on a house.

The present invention is a leaf guard for gutters, designated generally as 10 in FIGS. 1–3 (first embodiment) and as 60 in FIGS. 4–6 (second embodiment), that is designed to direct water flowing off of a roof and into a gutter while preventing leaves and other debris from entering the gutter.

As shown in FIGS. 1–3, the first embodiment of the leaf guard for gutters 10 is formed from an elongated sheet of rigid material into four sections—a planar section 20, a curved nose section 30, a trough section 40 and an outer lip section 50.

The planar section 20 is substantially flat with one or more rows 28 of elongated slits 22 aligned parallel to its roof-side edge 24. More preferably, the leaf guard 10 includes at least two rows 28 of elongated slits 22. Each slit 22 is oriented perpendicularly to the roof-side edge 24. The preferred length of each slit 22 is between ¼ inch and about 2 inches. The preferred width of each slit 22 is between about 1/32 inch and about ¼ inch, preferably about 1/16 inch, just wide enough to allow the flow of enough water through the slits in order to disrupt the activity of any insects. The slits 22 are evenly spaced with a uniform distance of between about 1 inch and about ¼ inch separating each slit 22 from each immediately adjacent slit 22 within each row 28. As shown in FIG. 1, a portion 26 of the planar portion 20 is securable to a roof R by being positioned between the substructure of the roof R and the shingles of the roof R.

The curved nose section 30 extends in a downward and then inward arc from the planar section 20 continuing its arc until it curls under the planar section 20 to form a trough section 40. The curved nose section 30 of the leaf guard 10 is solid, without apertures or perforations.

The trough section 40 extends first in a downward arc and then in an outward and upward arc from the nose section 30. The trough section 40 forms a trough with elongated slots 42 aligned along the base of the trough 40. The elongated slots 42 are oriented parallel to the roof-side edge 24 and are preferably about five inches in length.

An outer lip section 50 extends outward and then downward from the trough section 40 forming a corner that has a horizontal segment 54 and a vertical segment 56. The outer lip section 50 mates with the outside rim OR of a gutter G and has apertures 52 disposed on its vertical segment 56.

When a portion 26 of the planar section 20 is secured to the roof R of a house and the outer lip section 50 is secured to the outside rim OR of a gutter G on that house, as depicted in FIG. 1, water flowing off the roof R flows across the planar section 20, over the curved nose section 30, into the trough section 40, through the elongated slots 42, and into the gutter G. Under a principle known as the Coanda Effect, water flowing over the curved nose section 30 flows along its arc even though the arc curls under the planar section 20. Because leaves and other debris are not subject to the Coanda Effect, they do not flow along the arc but instead flow off the leaf guard 10, bypassing the trough section 40, and fall to the ground.

To prevent bees and other insects from nesting on the underside of the leaf guard 10, a small amount of the water flowing across the planar section 20 seeps through the elongated slits 22 rendering the area on the underside of the planar section 20 an undesirable nesting location for bees and other insects.

Each of the elongated slits 22 for the first embodiment of the leaf guard is formed by having the material on either side of the elongated slit bent upward. See FIG. 2. The elongated slits 22 of each row 28 can be aligned or offset from the elongated slits in the other rows of elongated slits. FIGS. 1–3 depict aligned elongated slits. In a preferred embodiment, the entire width of the planar section 20 will be covered with rows of elongated slits 28, except for the portion 26 of the planar section 20 for positioning under the roof R.

The leaf guard for gutters 10 can be constructed from a variety of different rigid materials. The preferred rigid material is metal. Copper, steel, and aluminum are suitable metals, but enamel coated aluminum is the preferred rigid material. The leaf guard 10 is bendable such that the slope of the planar section 20 relative to the trough section 40 can be changed to meet the varying needs of different roof styles by applying finger force thereto 10.

The apertures 52 in the outer lip section 50 are dimensioned to allow the threaded portion of commercially available gutter screws or the stem portion of a commercially available gutter rivets to pass through and into the outside rim OR of a gutter G thereby securing the outer lip section 50 to the outside rim OR of the gutter G. Additionally, the apertures 52 can be disposed on the horizontal segment 54 as well as on the vertical segment 56 of that section 50.

As shown in FIGS. 4–6, the second embodiment of the leaf guard for gutters 60 is formed from an elongated sheet of rigid material into three sections—a planar section 70, an inwardly bent connection section 90, and a curved nose section 80.

The planar section 70 is substantially flat with one or more rows 78 of elongated slits 72 aligned parallel to the planar section's 70 roof-side edge 74. The roof-side edge 74 of this embodiment is the line separating the planar section 70 and the inwardly bent connection section 90. The roof side edge 74 runs along the length of the leaf guard 60. More preferably, the leaf guard 60 includes at least two rows 78 of elongated slits 72. Each slit 72 is oriented perpendicularly to the roof-side edge 74. The preferred length of each slit 72 is between about ¼ inch and about 2 inches. The preferred width of each slit is between about 1/32 inch and about ¼ inch, preferably about 1/16 inch, just wide enough to allow the flow of enough water through the slits in order to disrupt the activity of any insects. The slits 72 are evenly spaced with a uniform distance of between about ¼ inch and about 1 inch separating each slit 72 from each immediately adjacent slit 72 within each row 78.

The curved nose section 80 extends in a downward curve and hangs just above the outer rim OR of the gutter G. The curved nose section 80 is preferably spaced between about ¼ inch and about ½ inch from the outer rim OR of the gutter G. The tip of the curved nose section 80 may optionally rest on gutter's facia hanger. The curved nose section 80 of the leaf guard 60 is solid, without apertures or perforations.

When the inwardly bent connection portion 90 is secured to the facia board F of a house and the curved nose section 80 is hanging above the outside rim OR of the gutter G on the house, as depicted in FIGS. 4 and 6, water flowing off the roof R flows across the planar section 70, over the curved nose section 80, and into the gutter G. Under a principle known as the Coanda Effect, water flowing over the curved nose section 80 flows along the arc of the curved nose section 80 even though the arc curls under the planar section 70. Because leaves and other debris are not subject to the Coanda Effect, they do not flow along the arc of the nose section 80 but instead flow off the leaf guard 60 missing the gutter G and thus fall to the ground.

To prevent bees and other insects from nesting on the underside of the leaf guard for gutter 60, a small amount of the water flowing across the planar section 70 seeps through the elongated slits 72 in the planar section 70 rendering the area on the underside of the planar section 70 an undesirable nesting location for bees and other insects.

These rows of elongated slits 78 also act to reduce the velocity of the water as it flows along the planer section 70 of the leaf guard 60, ensuring that the water flows along the length of the curved nose section 80 and into the gutter G.

Each of the elongated slits 72 for the second embodiment of the leaf guard preferably have a slope where one side of the material along the elongated slit 72 is bent upwards and the material on the opposite side of the elongated slit 72 is bent downwards. See FIG. 5. It is further preferred that each elongated slit 72 in each row of elongated slits 78 have slopes in the same direction. It is further preferred that each immediately adjacent row of elongated slits 78 have elongated slits 72 with slopes in the opposite direction. In a further preferred embodiment the elongated slits 72 of each adjacent row 78 are offset such that the elongated slits 72 of each adjacent row 78 do not align. In a preferred embodiment, essentially the entire width of the plainer section 70 will be covered with rows of elongated slits 78. The presence of additional rows of elongated slits 78 with varying slopes provide additional resistance to the water flow rate and thus further ensure that water will flow along the arch of the curved nose section 80 and into the gutter G.

The leaf guard 60 can be constructed from a variety of different rigid materials. The preferred rigid material is metal. Copper, steel, and aluminum are suitable materials, but enamel coated aluminum is the preferred rigid material. The leaf guard 60 is bendable such that the slope of the planar section 70 can be changed to meet the varying needs of different roof styles by applying finger force thereto.

The inwardly bent connection portion 90 of the leaf guard 60 is preferably connected to facia board F by commercially available gutter screws. The inwardly bent connection section 90 may also be connected directly to the wall of a building above a gutter G or to the inner rim IR of a gutter G by suitable means.

The leaf guard 60 is preferably available in stock pieces of about 4 foot in length. Each piece of stock leaf guard 60 need only be screwed into the facia board at the respective ends of the stock leaf guard piece. The preferred material of enamel coated aluminum does not require preformed apertures as the material is easily punctured by sharp tipped screws, but the inwardly bent connection section 90 could also be formed with apertures in order to facilitate the installation process.

It is to be understood that the different features of the two different embodiments depicted in FIGS. 1–3 and FIGS. 4–6 respectively can be combined as appropriate. For instance, the second embodiment of the leaf guard 60 may be constructed without the inwardly bent connection section 90, but instead constructed with a portion 26 of the substantially planar section 70 adapted for connection to the roof R of a house as depicted in FIGS. 1 and 3. The first embodiment of the leaf guard 10 depicted in FIG. 2 could have the elongated slit arrangement of the second embodiment of the leaf guard 60 as depicted in FIG. 5. Additionally, the second embodiment of the leaf guard 60 depicted in FIG. 5 could have the elongated slit arrangement of the first embodiment of the leaf guard 10 as depicted in FIG. 5.

It is to be understood that the present invention is not limited to the embodiments described above, but encompasses any and all embodiments within the scope of the following claims.

I claim:

1. A leaf guard for directing water into a gutter while preventing debris from entering the gutter, comprising:

an elongated sheet of material having:

a substantially planar portion, a roof-side edge and at least a first row and an adjacent second row of elongated slits defined in said planar portion;

wherein said first and second rows of elongated slits are substantially parallel to said roof-side edge; and wherein each one of said elongated slits is oriented substantially perpendicular to said roof-side edge, and each slit of said first row is offset from the corresponding slit of the adjacent second row in a direction parallel to the roof edge.

2. The leaf guard according to claim 1, wherein each of said elongated slits is bounded by a first side of material and an opposite second side of material, wherein said first side of material slopes upward and said second side of material slopes downward.

3. The leaf guard according to claim 2, wherein each of said elongated slits of the same row have first and second sides of material that slope in the same direction.

4. The leaf guard according to claim 1, wherein said elongated sheet of material is constructed of a metal selected from the group consisting of aluminum, steel, copper and enamel coated aluminum.

5. The leaf guard according to claim 1, wherein each of said elongated slits is between ½ inch and 2 inches in length.

6. The leaf guard according to claim 1, wherein said elongated sheet of material further includes a curved nose portion that curves inwardly beneath said substantially planar portion.

7. The leaf guard according to claim 6, wherein said curved nose section is adapted to hang above the outside rim of a gutter such that a gap of between about ¼ inch and about ½ inch is formed between said curved nose section and said outside rim of the gutter.

8. The leaf guard according to claim 1, wherein said elongated sheet of material further includes a inwardly bent connection portion adjacent said roof-side edge, wherein said inwardly bent connection portion is adapted for attachment to a vertical support structure.

9. The leaf guard according to claim 1, wherein each of said elongated slits is separated from each immediately adjacent elongated slit by a distance of between about ¼ inch and about 1 inch.

10. A leaf guard for directing water into a gutter while preventing debris from entering the gutter, comprising:

an elongated sheet of material including a substantially planar portion, a roof-side edge, and a curved nose portion;

said planar portion defining at least one row of elongated slits, wherein said elongated slits are oriented substantially perpendicular to said roof-side edge;

a connection portion adjacent the roof-side edge, said connection portion being a bent extension of said roof-side edge wherein said bent extension of said connection portion is adapted for attachment said curved nose portion is opposite said bent extension of said connection portion, said curved nose portion extending, in an arc, downwardly and underneath said planar portion.

11. The leaf guard according to claim 10, wherein said at least one row of elongated slits includes at least two rows of elongated slits, said rows of elongated slits are substantially parallel to said roof-side edge.

12. The leaf guard according to claim 11, wherein each of said elongated slits is bounded by said planar material on a first side, and an opposite second side;

wherein said planar material slopes upward on said first side, and said planar material slopes downward, on said second side;

whereby said planar material on said first and second sides of each of said elongated slits of the same row slope in the same direction, respectively.

13. A leaf guard for directing water into, and preventing debris from entering a gutter, comprising:

an elongated sheet of material having a substantial planar portion between first and second ends defining a forward edge and a rearward edge;

said substantially planar portion also defining a plurality of elongated slits arranged in a plurality of rows along said planar portion between said first and second ends, and said forward and rearward edges;

wherein each of said plurality of rows are substantially parallel to said rearward edge;

each one of said elongated slits is oriented substantially perpendicular to said rearward edge;

each one of said elongated slits is bounded by said planar material on a first side and an opposite second side, said first and second sides extend in a direction parallel to said first and second ends;

said material on said first side has an upward slope, and on said second side has a downward slope;

whereby said material on each said first and said second sides of said elongated slits of each one of said plurality of rows slope in the same direction, respectively.

14. The leaf guard according to claim 13, wherein said plurality of rows includes at least two adjacent rows of elongated slits.

15. The leaf guard according to claim 14, wherein of said at least two adjacent rows of elongated slits are offset from each other in a direction parallel to said forward edge.

16. The leaf guard according to claim 13, wherein each of said elongated slits is between ½ inch and 2 inches in length.

17. The leaf guard according to claim 13, wherein said forward edge includes a curved nose portion, formed substantially beneath said substantially planar portion.

18. The leaf guard according to claim 17, wherein said curved nose portion is adapted to hang above an outside rim of a gutter;

whereby a gap in the range from about ¼ inch to about ½ inch is formed between said curved nose section and the outside rim of the gutter.

19. The leaf guard according to claim 13, wherein said rearward edge includes a connection portion;

whereby said connection portion is adapted for attachment to a vertical support structure above a gutter.

20. The leaf guard according to claim 13, wherein each one of said elongated slits is separated from each immediately adjacent elongated slit by a distance in the range including ¼ inch and to one inch.

* * * * *